US010159348B2

(12) United States Patent
Mackert

(10) Patent No.: US 10,159,348 B2
(45) Date of Patent: Dec. 25, 2018

(54) SEATING FURNITURE CHASSIS

(71) Applicant: Innotec Motion GmbH, Lippstadt (DE)

(72) Inventor: Michael Mackert, Ruethen (DE)

(73) Assignee: INNOTEC MOTION GMBH, Lippstadt (DE)

( * ) Notice: Subject to any disclaimer, the term of this patent is extended or adjusted under 35 U.S.C. 154(b) by 0 days.

(21) Appl. No.: 15/340,780

(22) Filed: Nov. 1, 2016

(65) Prior Publication Data

US 2017/0119157 A1 May 4, 2017

(30) Foreign Application Priority Data

Nov. 4, 2015 (DE) ..... 20 2015 105 865 U

(51) Int. Cl.
*A47C 3/24* (2006.01)
*A47C 3/20* (2006.01)

(52) U.S. Cl.
CPC . *A47C 3/24* (2013.01); *A47C 3/20* (2013.01)

(58) Field of Classification Search
CPC ..... A47C 3/24; A47C 3/245; A47C 3/20
USPC ..... 297/344.15–344.17, 330
See application file for complete search history.

(56) References Cited

U.S. PATENT DOCUMENTS 4,557,454 A * 12/1985 Urella ..... A61G 15/02 248/422
5,556,163 A * 9/1996 Rogers, III ..... A47C 1/023 297/330
5,803,547 A 9/1998 Brown
7,163,263 B1 * 1/2007 Kurrasch ..... A47C 1/0242 297/217.3
7,775,592 B2 * 8/2010 Becker ..... B60N 2/0232 297/330
7,971,937 B2 * 7/2011 Ishii ..... B60N 2/0232 297/330
2012/0222510 A1 * 9/2012 Winther ..... F16H 25/20 74/89.23
2013/0200665 A1 * 8/2013 Stanic ..... B60N 2/164 297/216.1
2016/0206099 A1 7/2016 Robertson

OTHER PUBLICATIONS

Co-pending, co-owned U.S. Appl. No. 15/340,765, filed Nov. 1, 2016.

* cited by examiner

*Primary Examiner* — Mark R Wendell
(74) *Attorney, Agent, or Firm* — Cohen & Hildebrand, PLLC

(57) ABSTRACT

A seating furniture chassis including a drive mechanism, a drive shaft, a gear mechanism and a lifting mechanism. The drive mechanism sets the drive shaft in rotation, while the lifting mechanism raises and lowers a seat face. The drive shaft is connected to the lifting mechanism via the gear mechanism. Rotation of the drive shaft in a first direction triggers raising of the seat face, while rotation of the drive shaft in a second direction triggers lowering of the seat face.

4 Claims, 1 Drawing Sheet

SEATING FURNITURE CHASSIS

This is an application claiming priority to DE 20 2015 105 865.9, filed on Nov. 4, 2015, which is incorporated by reference in its entirety.

BACKGROUND OF THE INVENTION

The present invention relates to a seating furniture chassis for a seating furniture item having lifting means for raising and lowering a seat face of the seating furniture item.

Seating furniture chassis are known from the prior art, in which lifting means are provided for raising and lowering a seat face. Here, a particularly large amount of installation space is required for the arrangement of a drive means and the lifting means, however, with the result that the said seating furniture chassis are relatively large and bulky and cannot be installed in seating furniture items with a relatively small amount of installation space.

In contrast, the invention is based on the object of providing a more compact seating furniture chassis with lifting means. Moreover, a system is to be provided comprising a seating furniture chassis of this type and a seat face.

The seating furniture chassis comprises a drive means, a drive shaft, a gear mechanism and lifting means. The drive means can be, for example, a motor. The drive means is configured to set the drive shaft in rotation.

The lifting means are configured to raise and lower a seat face of the seating furniture item.

It is provided according to the invention that the drive shaft is connected to the lifting means via the gear mechanism in such a way that the rotation of the drive shaft in a first direction triggers raising of the seat face and the rotation of the drive shaft in a second direction triggers lowering of the seat face. The drive means can be configured to trigger the rotation of the drive shaft both in the first and in the second direction.

This arrangement of the components of the seating furniture chassis makes a particularly compact overall design possible, with the result that the seating furniture chassis can be used even in the case of seating furniture items, in which there is a relatively small amount of installation space.

BRIEF SUMMARY OF THE INVENTION

According to one embodiment of the invention, the lifting means can be configured as threaded spindles. Threaded spindles are particularly stable and compact lifting means.

According to one embodiment of the invention, the drive means can extend in a horizontal direction and the lifting means can extend in a vertical direction. This overall design is particularly compact. It is possible, in particular, that the lifting means are arranged in lateral regions of the seating furniture chassis.

According to one embodiment of the invention, the drive means can be mounted in a floating manner. As a result, vibrations which are caused by the drive means are absorbed and are transmitted to a less pronounced extent or even not at all to the remaining components of the seating furniture chassis, as a result of which the comfort for the user is improved.

According to one embodiment of the invention, the gear mechanism can be configured as a bevel gear mechanism or a worm gear mechanism. Both a bevel gear mechanism and a worm gear mechanism are particularly compact gear mechanisms.

BRIEF DESCRIPTION OF THE DRAWINGS

Further features and advantages of the present invention will become clear using the following description of preferred exemplary embodiments with reference to the appended drawings. Here, the same reference numerals are used for identical or similar components and for components with identical or similar functions. In the figures.

DETAILED DESCRIPTION OF THE INVENTION

Figure 1:
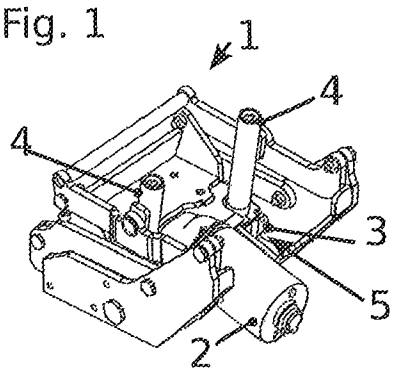
FIG. 1 shows a diagrammatic perspective view of a seating furniture chassis according to one embodiment of the invention in a first position.
Figure 2:
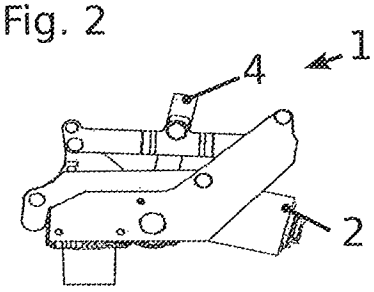
FIG. 2 shows a diagrammatic side view of the seating furniture chassis from FIG. 1 in the first position.
Figure 3:
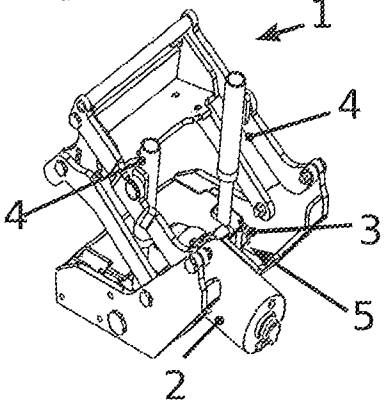
FIG. 3 shows a diagrammatic perspective view of the seating furniture chassis from FIG. 1 in a second position.
Figure 4:
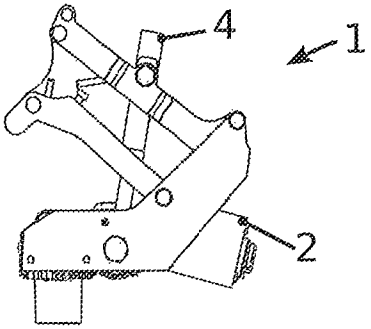
FIG. 4 shows a diagrammatic side view of the seating furniture chassis from FIG. 3 in the second position.
Figure 5:
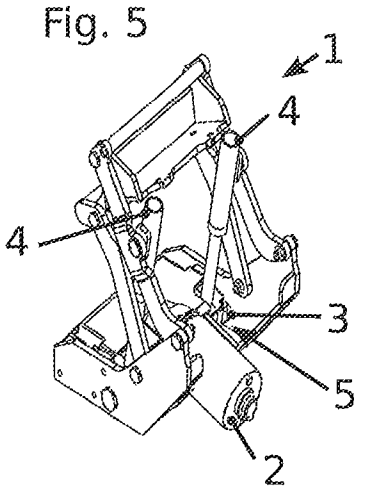
FIG. 5 shows a diagrammatic perspective view of the seating furniture chassis from FIG. 3 in a third position.
Figure 6:
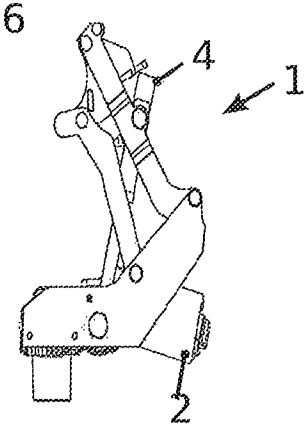
FIG. 6 shows a diagrammatic side view of the seating furniture chassis from FIG. 5 in the third position.

The first position which is shown in FIGS. 1 and 2 is a position, in which the seat face of the seating furniture item is in the lowest position. The seat face is slightly raised in FIGS. 3 and 4. The seat face is in the uppermost position in FIGS. 5 and 6.

In order to adjust the seat face, the seating furniture chassis 1 comprises a drive means 2, a drive shaft 5, a gear mechanism 3 and lifting means 4. The drive shaft can be set in rotation by the drive means 2 and is arranged in a horizontal direction parallel to a floor surface, on which the seating furniture item can stand. The gear mechanism 3 can be configured as a bevel gear mechanism or as a worm gear mechanism. The gear mechanism 3 is connected both to the drive shaft and to the lifting means 4. The lifting means 4 are configured as threaded spindles which extend in the vertical direction.

During operation, the drive shaft is set in rotation by way of the drive means 2. The said rotational movement is converted via the gear mechanism 3 into a rotational movement of the lifting means 4. Since the lifting means 4 are threaded spindles, the lifting means are lengthened or shortened during a rotation depending on the rotational direction. Since the drive means 2 can set the drive shaft in rotation in two different directions, a decision can be made by way of the selection of the rotational direction as to whether the seat face is to be raised or lowered.

On account of the overall design and the use of the bevel gear mechanism or the worm gear mechanism and the threaded spindles as lifting means, the seating furniture chassis 1 can be of particularly compact construction.

Every issued patent, pending patent application, publication, journal article, book or any other reference cited herein is each incorporated by reference in their entirety.

The invention claimed is:

1. A seating furniture chassis (1) for a seating furniture item, comprising: a drive mechanism (2), a drive shaft, a gear mechanism (3) and a lifting mechanism (4), wherein the drive mechanism (2) is configured to set the drive shaft in rotation, wherein the lifting mechanism (4) is configured to raise and to lower a seat face of the seating furniture item, wherein the drive shaft is connected to the lifting mechanism (4) via the gear mechanism (3) in such a way that the rotation of the drive shaft in a first direction triggers raising of the seat face and the rotation of the drive shaft in a second direction triggers lowering of the seat face; wherein the lifting mechanism (4) has a first end and an opposite second end; the gear mechanism (3) is connected both to the drive shaft and to the first end of the lifting mechanism (4); and wherein at both a lowest position and an uppermost position of the seat face of the seating furniture item the drive mechanism (2) is positioned below the second end of the lifting mechanism.

2. The seating furniture chassis (1) according to claim 1, wherein the drive shaft extends in a horizontal direction and the lifting mechanism (4) extends in a vertical direction.

3. The seating furniture chassis (1) according to claim 1, wherein the drive mechanism (2) is mounted in a floating manner.

4. A system, comprising a seating furniture chassis (1) according to claim 1 and a seat face which is connected to the lifting mechanism (4).

* * * * *